US005233778A

United States Patent [19]

Pink, Sr.

[11] Patent Number: 5,233,778

[45] Date of Patent: Aug. 10, 1993

[54] MUZZLE LOADING CLEANING ROD RETRIEVER

[76] Inventor: William K. Pink, Sr., HCR 76, Box 75, Aberdeen, Wash. 98520

[21] Appl. No.: 856,390

[22] Filed: Mar. 23, 1992

[51] Int. Cl.[5] ..... F41C 27/00; B25B 7/00

[52] U.S. Cl. ..... 42/95; 81/300

[58] Field of Search ..... 42/90, 95; 81/3.05, 81/300, 488, 418, 424.5; 30/120.4

[56] References Cited

U.S. PATENT DOCUMENTS

| | | | |
|---|---|---|---|
| 69,563 | 10/1867 | Herde | 81/300 |
| 1,107,684 | 8/1914 | Mallory | 81/300 |
| 1,353,719 | 9/1920 | Buresch | 81/300 |
| 2,361,769 | 10/1944 | Hollingsworth | 81/424.5 |
| 2,444,634 | 7/1948 | Daniel | 30/120.4 |
| 3,329,044 | 7/1967 | Singer | 81/424.5 |
| 4,843,747 | 7/1989 | Echeberria | 42/90 |

*Primary Examiner*—Charles T. Jordan
*Attorney, Agent, or Firm*—S. Michael Bender

[57] ABSTRACT

A plier-like tool is designed to grip the end of a muzzle loader bore cleaning rod so as to assist in the removal of the rod from the gun. The tool is particularly useful in removing cleaning rods which become stuck in rifle barrels. A collet is attachable to the tool to assist in aligning the tool over a cleaning rod and to provide additional gripping force.

2 Claims, 4 Drawing Sheets

MUZZLE LOADING CLEANING ROD RETRIEVER

BACKGROUND OF THE INVENTION

1. Field of the Invention

The present invention relates to gripping tools and more particularly pertains to a gripping tool which is designed to assist in retrieving a stuck rifle cleaning rod.

2. Description of the Prior Art

Rifle bore cleaning tools are well known in the prior art. For example, U.S. Pat. No. 4,962,607, which issued to L. Baldwin on Oct. 16, 1990, discloses a typical rifle bore cleaning tool which is designed to be inserted into the bore of a rifle for the purpose of removing accumulated residue and burnt gun powder. With respect to black powder rifles, quite frequently the muzzle loader cleaning rods become stuck in the rifle bores due to high concentrations of burnt gun powder and other residue. As such, there is a continuing need for improved cleaning rod constructions wherein they could be more easily removed from a rifle bore or at least some type of tool to assist in such a removal and in this respect, the present invention substantially fulfills this need.

SUMMARY OF THE INVENTION

In view of the foregoing disadvantages inherent in the known types of muzzle loader cleaning rods now present in the prior art, the present invention provides an improved tool construction wherein the same can be utilized to retrieve muzzle loader cleaning rods which become stuck within a rifle bore. As such, the general purpose of the present invention, which will be described subsequently in greater detail, is to provide a new and improved muzzle loader cleaning rod retriever which has all the advantages of the prior art rifle cleaning bore tools and none of the disadvantages.

To attain this, the present invention essentially comprises a plier-like tool which is designed to grip the end of a muzzle loader bore cleaning rod so as to assist in the removal of the rod from the gun. The tool is particularly useful in removing cleaning rods which become stuck in rifle barrels. A collet is attachable to the tool to assist in aligning the tool over a cleaning rod and to provide additional gripping force.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved muzzle loader cleaning rod retriever which has all the advantages of the prior art muzzle loader cleaning rod retrievers and none of the disadvantages.

It is another object of the present invention to provide a new and improved muzzle loader cleaning rod retriever which may be easily and efficiently manufactured and marketed.

It is a further object of the present invention to provide a new and improved muzzle loader cleaning rod retriever which is of a durable and reliable construction.

An even further object of the present invention is to provide a new and improved muzzle loader cleaning rod retriever which is susceptible of a low cost of manufacture with regard to both materials and labor, and which accordingly is then susceptible of low prices of sale to the consuming public, thereby making such muzzle loader cleaning rod retrievers economically available to the buying public.

Still yet another object of the present invention is to provide a new and improved muzzle loader cleaning rod retriever which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
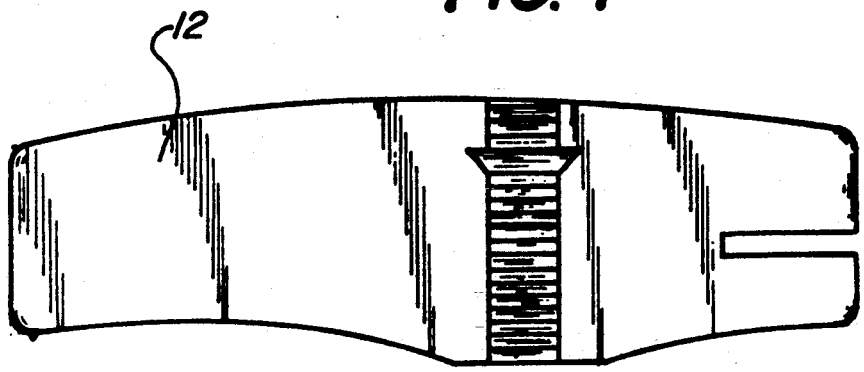
FIG. 1 is a side elevation view of a left side half section of the muzzle loader cleaning rod retriever comprising the present invention.
Figures 2, 3:
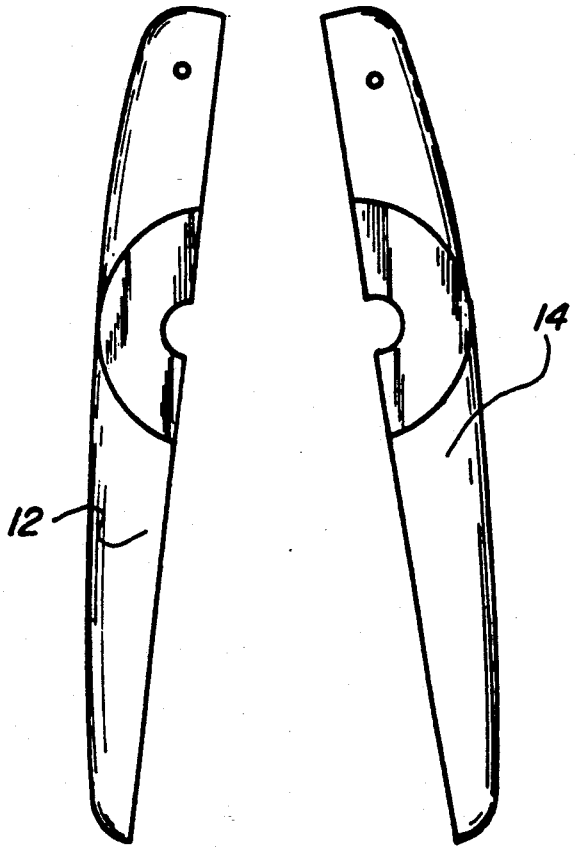
FIG. 2 is a top plan view of the left side half section.
FIG. 3 is a top plan view of the right side half section.
Figure 4:
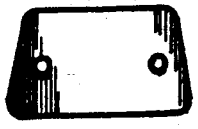
FIG. 4 is a top plan view of a cross plate utilized to connect the left and right half sections.
Figure 5:
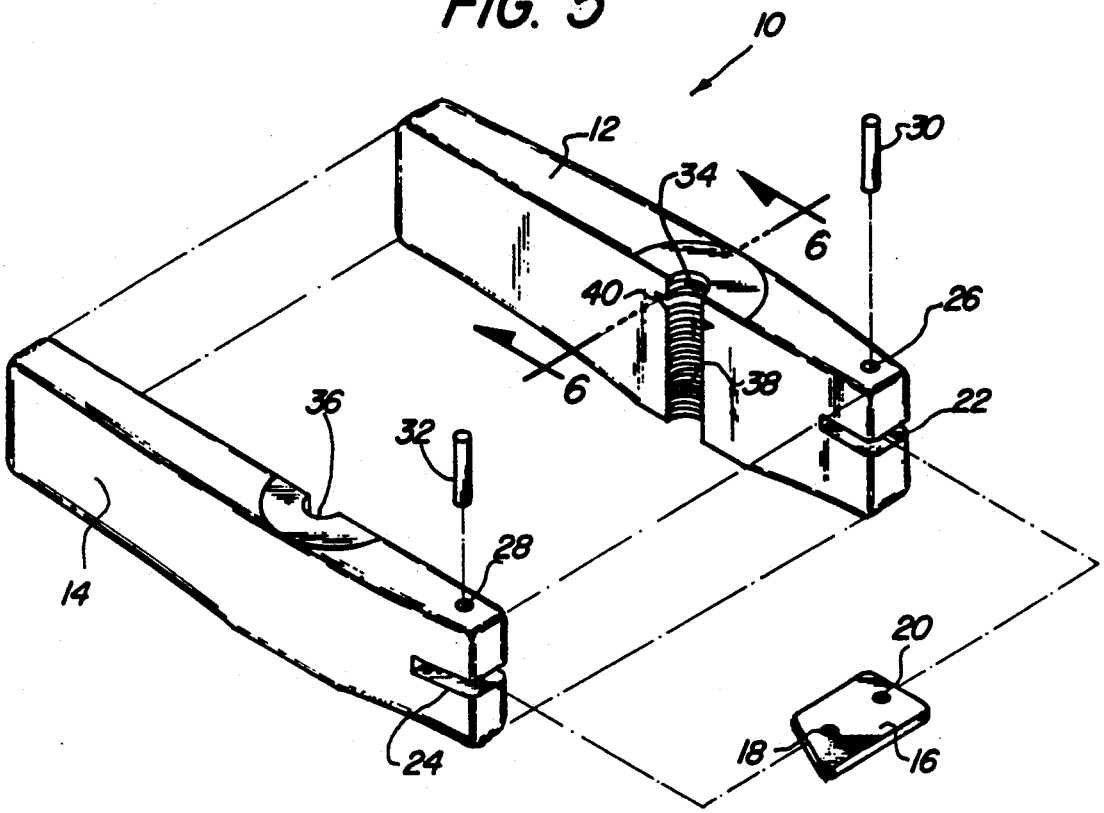
FIG. 5 is an exploded perspective view of the invention.

With reference now to the drawings, and in particular to FIG. 1-6 thereof, a new and improved muzzle loader cleaning rod retriever embodying the principles and concepts of the present invention and generally designated by the reference numeral 10 will be described.

More specifically, it will be noted that the muzzle loader cleaning rod retriever essentially consists of a left side half section 12 and a right side half section 14 which are pivotally attachable together by a cross plate 16. The cross plate 16 is of a trapezoidal design and includes two through-extending apertures 18,20. The handle section 12 includes an end-positioned slot 22, and the handle section 14 includes a similar end-positioned slot 24. The cross plate 16 is positionable within the slots 22,24, and respective through-extending apertures 26,28 located in the handle sections 12,14 are alignable with the apertures 20,18 in the cross plate. A first pin 30 is positionable through both the aperture 26 and the aperture 20 so as to effect a pivotal connection of the cross plate 16 to the handle section 12, and a second pin 32 is positionable through the apertures 28,18 to effect a similar pivotal connection to the cross plate. As such, the two handle sections 12,14 pivot towards and away from each other when the cross plate 16 is appropriately attached in a now apparent manner.

A cross-extending groove 34 is formed in the handle section 12 and a similar cross-extending groove 36 is formed in the handle section 14. The grooves 34,36 are aligned and serve to grip a muzzle loader cleaning rod when the handle sections 12,14 move towards each other. Each of the grooves 34,36 are provided with a plurality of gripping teeth members which are generally designated by the reference numeral 38, and a large inwardly directed groove 40 is positioned in each of the grooves 34,36. The groove 40 is designed to capture a standard protrusion which is present around the periphery of a conventional muzzle loader cleaning rod.

Figure 6:
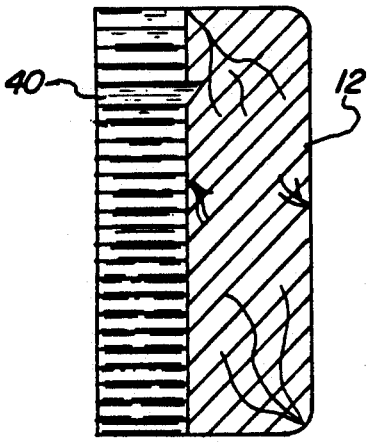
FIG. 6 is a cross-sectional view of the invention as viewed along the lines 6—6 in FIG. 5.
Figure 7:
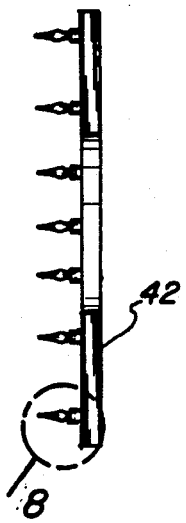
FIG. 7 is a side elevation view of a collet plate forming a part of the present invention.
Figure 9:
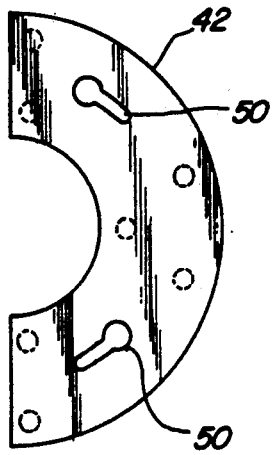
FIG. 9 is a top plan view of the plate.
Figure 8:
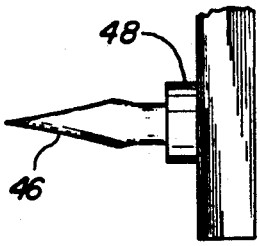
FIG. 8 is a detail view of the plate taken from FIG. 7.

In use then, this first embodiment 10 of the invention is designed to pull stuck cleaning rods from black powder rifle barrels. When the stuck cleaning rod is positioned within the aligned grooves 34,36, a user need only to squeeze the handle sections 12,14 towards one another to effect a firm gripping of the rod, whereby the rod may be twisted and pulled to remove it from the rifle barrel. As best illustrated in FIG. 6 of the drawings, the preferred embodiment of the invention can be manufactured from wood although it is within the intent and purview of the invention to utilize any known material which would function in the intended manner.

Figure 10:
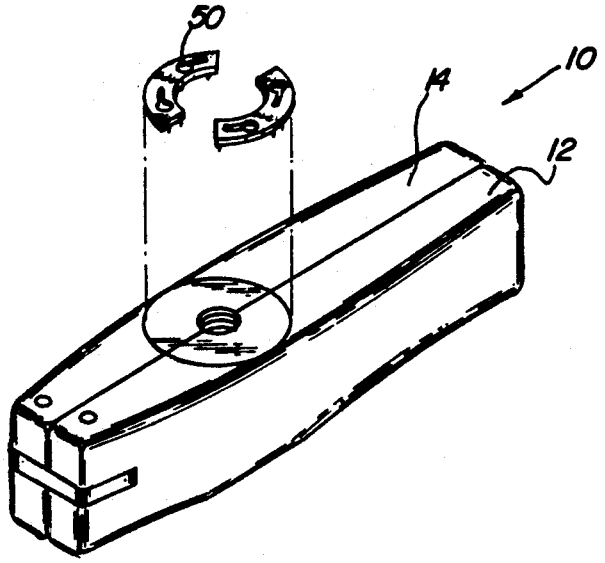
FIG. 10 is a perspective view illustrating the attachment of two collett plates to the cleaning rod retriever.
Figure 14:
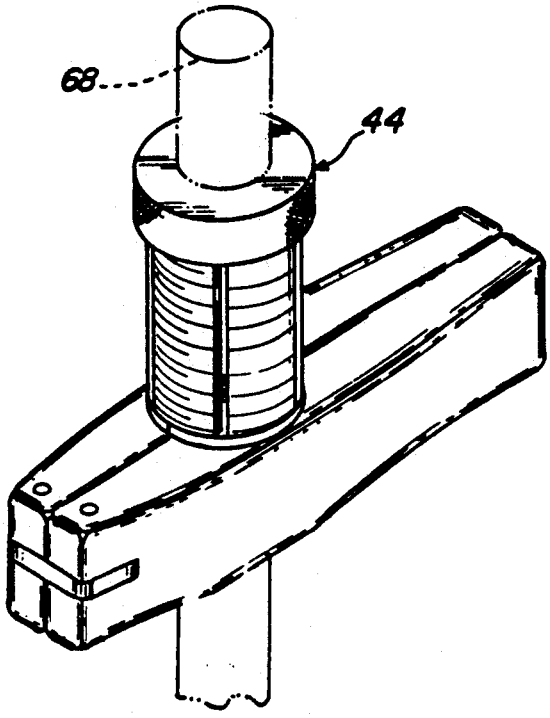
FIG. 14 is a perspective view illustrating the collet attached to the muzzle loader cleaning rod retriever.

FIGS. 7-10 illustrate the structure and attachment of a plurality of collet plates 42 to the tool 10. The collet plates 42 facilitate the attachment of a collet 44, as best shown in FIG. 14, to the tool 10 for a purpose which will be subsequently described. Each collet plate 42 is of a half-moon, planar construction and is formed from a strong metallic material. A plate 42 includes a plurality of downwardly extending spikes 46 which are integrally attached to the plate and which may be forced into the wood handle sections 12,14 as best shown in FIG. 10. Each spike 46 has a spacer 48 positioned next to the plate 42 so as to prevent a plate from coming into direct contact with the wooden handle sections 12,14. Additionally, as shown in both FIGS. 9 and 10, a plurality of keyways 50 are formed in a through-extending manner on the top surface of a collet plate 42.

Figure 11:
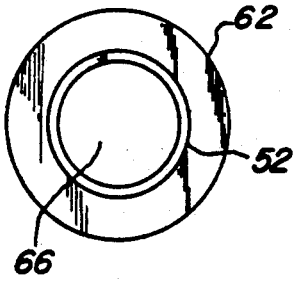
FIG. 11 is a top plan view of a collet forming a part of the present invention.
Figure 12:
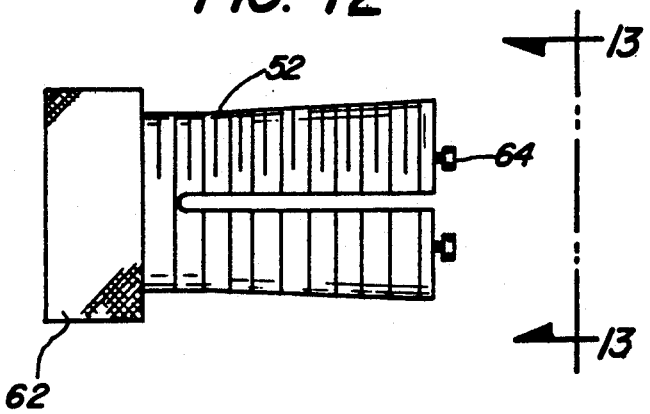
FIG. 12 is a side elevation view of the collet.
Figure 13:
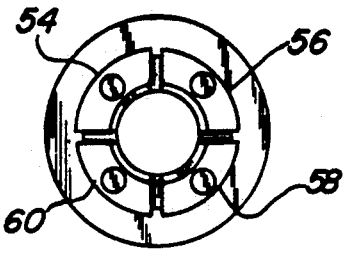
FIG. 13 is a bottom plan view of the collet as viewed along the line 13—13 in FIG. 12.

FIGS. 11-14 illustrate the use of the aforementioned collet 44. The collet 44 essentially comprises a threaded tubular member 52 which includes four flared out leg portions 54,56,58,60 with a knurled nut 62 being threadably moveable along the entire length of the tubular member. Each downwardly extending leg 54,56,58,60 is provided with an integral headed pin structure 64. As shown in FIG. 11, the knurled nut 62 is concentrically positioned over the tubular housing 52 so that a through-extending bore 66 is defined by this construction. In this regard, the bore 66 is of a diameter substantially similar to that of a muzzle loader cleaning rod whereby the collet may be positioned over such a rod 68 as best illustrated in FIG. 14.

In use, the collet 44 is attachable to the tool 10 by having each of the headed pins 64 positioned within a respective keyway 50 formed in the collet plates 42. The spacers 48 formed on the collet plates 42 allow the pins 64 to be inserted within the keyways 50 and a simple twisting then locks the collet 42 to the tool 10. With the collet 44 and its associated tool 10 positioned over a stuck gun cleaning rod 68 as shown in FIG. 14, the knurled nut 62 may be rotated downwardly over the tubular housing 52. Inasmuch as the legs 54,56,58,60 define an expanding diameter of the housing 52, the knurled nut will effectively force the legs inwardly into a firm gripping relationship with the stuck cleaning rod 68. As such, the cleaning rod 68 will be firmly attached to the collet 44, as well as the retrieving tool 10, whereby a user can provide a greater twisting and pulling force on the cleaning rod to effectively remove it from a muzzle loader barrel.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for retrieving a muzzle loader cleaning rod comprising:

first handle means;

second handle means;

cross plate means for pivotally connecting said first and second handle means together;

first groove means formed in said first handle means; and second groove means formed in said second handle means, gripping teeth means formed in said first and second groove means, said first and second groove means being alignable to grip respective sides of said muzzle loader cleaning rod, thereby to facilitate a retrieving of said muzzle loader cleaning rod from a rifle barrel, said apparatus further including collet means attachable to said first and second handle means, said collet means facilitating a more secure grip of said apparatus to said muzzle loader cleaning rod while permitting a user to grip said apparatus in a more convenient manner, wherein said collet means includes at least one collet plate attachable to said apparatus, and a collet selectively attachable to said collet plate, said collet serving to more firmly grip said muzzle loader cleaning rod in response to a threaded movement of a nut along an axial length of said collet.

2. Apparatus for retrieving a muzzle loader cleaning rod having first and second surface characteristics comprising:

first handle means;

second handle means;

means for pivotally connecting said first and second handle means together;

first groove means formed in said first handle means; and second groove means formed in said second handle means, first and second gripping teeth means formed in said first and second groove means, said first gripping teeth means configured to engage said rod in the region of said first surface characteristic and comprising a multiplicity of similar-sized grooves forming gripping teeth extending axially with respect to said first and second groove means, said second gripping teeth means configured to engage said rod in the region of said second surface characteristic and comprising at least one radially extending groove of substantially greater size than said multiplicity of similar-sized grooves, said at least one radially extending groove of substantially greater size being disposed medially of the axial extent of said multiplicity of similar-sized grooves, said first and second groove means being alignable to grip respective sides of said muzzle loader cleaning rod, thereby to facilitate a retrieving of said muzzle loader cleaning rod from a rifle barrel.

* * * * *